United States Patent [19]

Kawai et al.

[11] 4,246,048

[45] Jan. 20, 1981

[54] FORGED ATOMIC POWER PLANT PARTS

[75] Inventors: Mitsuo Kawai, Yokohama; Kanji Kawaguchi, Shizuoka; Hisato Kamohara; Matsuo Miyazaki, both of Yokohama, all of Japan

[73] Assignee: Tokyo Shibaura Electric Co., Ltd., Japan

[21] Appl. No.: 30,226

[22] Filed: Apr. 16, 1979

Related U.S. Application Data

[63] Continuation of Ser. No. 804,799, Jun. 8, 1977, abandoned.

[30] Foreign Application Priority Data

Jul. 28, 1976 [JP] Japan ..... 51-89029

[51] Int. Cl.[3] ..... C22C 19/05

[52] U.S. Cl. ..... 148/32; 75/122; 75/134 F; 75/171; 148/32.5; 176/88; 176/93 R

[58] Field of Search ..... 75/171, 170, 122, 134 F; 148/32, 32.5; 176/88, 93 R

[56] References Cited

U.S. PATENT DOCUMENTS

| | | | |
|---|---|---|---|
| 3,015,558 | 1/1962 | Grant et al. | 75/171 |
| 3,573,901 | 4/1971 | Economy | 75/171 |

*Primary Examiner*—R. Dean

*Attorney, Agent, or Firm*—Finnegan, Henderson, Farabow, Garrett & Dunner

[57] ABSTRACT

A wear-resistant alloy for an atomic power plant which is essentially formed of 10 to 45% by weight of chromium; 1.5 to 6% by weight of at least one metal component selected from the group consisting of aluminium and titanium; 0 to 20% by weight of molybdenum; and nickel as the remainder, and atomic power plant parts prepared from the alloy having said composition.

6 Claims, No Drawings

FORGED ATOMIC POWER PLANT PARTS

This is a continuation of application Ser. No. 804,799, filed June 8, 1977, abandoned.

BACKGROUND OF THE INVENTION

This invention relates to a wear-resistant alloy which can be suitably used not only as an erosion shield provided for the terminal blade of the low pressure section of a turbine used with an atomic power plant but also as the sliding parts of control rods.

As is well known, a boiling water type atomic power plant is a system for generating power by revolving a turbine, using steam produced in a nuclear reactor. With the boiling water type nuclear reactor, water is heated into steam, which in turn is conducted through a main steam pipe to a turbine for its revolution. Steam gradually increases in humidity while being circulated for revolution of a turbine. Wet steam is conducted to a condenser after leaving a turbine to be converted into water. The water is returned to the reactor after being preheated by a feed water heater.

In the atomic power plant, some parts are subject to little wear such as a pipe while used as a main steam pipe, other pines provided for a condenser and feed water heater, the blades of the high pressure section of a turbine and the casing thereof are generally prepared from, for example, 18-8 stainless steel. On the other hand, parts subject to severe wear comprising erosion by high speed steam streams or violent cavitation erosions, such as, for example, the erosion shield provided for the terminal blade of the low pressure section of a turbine, the face section of valves, the sliding section of control rods and parts of a jet pump, should be built of wear-resistant material. These parts undergoing heavy erosions are generally formed of a cobalt-chromium-tungsten alloy sold under the trademark Stellite containing about 50% by weight of cobalt. However, the above-mentioned steel material and a cobalt-chromium-tungsten alloy sold under the trademark Stellite are gradually corroded or eroded during long use, giving rise to the growth of corrosion or erosion refuse such as ions or fine particles of metals. This corrosion or erosion refuse is accumulated in a reactor by circulation of steam or water.

When bombarded by neutrons emitted from fuel rods the corrosion or erosion refuse is presumably converted into radioactive corrosion or erosion product. Radioactive corrosion or erosion product arising from steel material has a very short half life, whereas radioactive corrosion or erosion product whose nucleus is formed of cobalt 60 derived from cobalt 59 contained in a cobalt-chromium-tungsten alloy sold under the trademark; Stellite has a relatively long half life. Radiation sent forth from said radioactive corrosion or erosion product increases in amount as the run of an atomic power plant is prolonged. Therefore, it sometimes happens that when a periodic maintenance or repair of an atomic power plant is undertaken, the atomic power plant has to be stopped for a considerably long period in order to wait for the sufficient attenuation of radiation issuing from radioactive corrosion or erosion product deposited in the atomic power plant.

Hitherto, therefore, demand has been made to develop a wear-resistant material free from an element such as cobalt which gives rise to the growth of radioactive corrosion or erosion product having a long half life, in order to shorten the rest period of an atomic power plant as much as possible for its efficient operation.

SUMMARY OF THE INVENTION

It is accordingly an object of this invention to provide a cobalt-free and highly wear-resistant alloy for an atomic power plant.

Another object of the invention is to provide parts of an atomic power plant which are prepared from a cobalt-free and highly wear-resistant alloy.

A wear-resistant alloy embodying this invention for an atomic power plant is essentially formed of a 10 to 45% by weight of chromium; 1.5 to 6% by weight of at least one metal component selected from the group consisting of aluminium and titanium; 0 to 20% by weight of molybdenum; and nickel as the remainder. Further, this invention includes parts for a boiling water type atomic power plant, such as the face section of various valves, the chamber of a jet pump, or erosion shield provided for the terminal blade of the low pressure section of a turbine and the sliding sections of control rods.

DETAILED DESCRIPTION OF THE PREFERRED EMBODIMENTS

The wear-resistant alloy of this invention is essentially formed of a chromium-aluminium and/or titanium-nickel system. Where need arises, however, part of the nickel may be replaced by up to 20% by weight of molybdenum.

Chromium, a component of the above-mentioned alloy, elevates the erosion-resistance of the alloy and increases the mechanical strength of the alloy. Therefore, chromium should preferably be incorporated at a concentration of 10 to 45% by weight of preferably 30 to 40% by weight. A smaller content of chromium than 10% by weight fails to realize the above-mentioned desired effects. Conversely, a larger content of chromium than 45% by weight gives rise to the prominent precipitation of initial coarse crystals, preventing the alloy as a whole from presenting a sufficiently high wear resistance.

Aluminium or titanium provides an intermetallic compound by reacting with nickel and contributes to the elevation of the mechanical strength of the subject alloy and its wear resistance. The component of aluminium or titanium should be incorporated at a concentration of 1.5 to 6% by weight or preferably 3 to 5% by weight. A smaller content of aluminium or titanium than 1.5% by weight fails to attain the aforesaid favorable effects. Conversely, a larger content of aluminium or titanium than 6% by weight results in the lower toughness and mechanical strength of the alloy as a whole. If necessary, molybdenum is added to improve the corrosion resistance of the alloy and its erosion resistance. However, addition of molybdenum in a larger amount than 20% by weight should be avoided, because of the resultant decline in the toughness of the alloy.

Where desired, aluminium or titanium, a component of the wear-resistant alloy of this invention may be partly replaced by niobium or tantalum. Further, the nickel component may be partly substituted by iron and the molybdenum component by tungsten. Where component metals are melted to produce the subject alloy, manganese or silicon added as a deoxidizing or denitrogenizing agent may be carried into the alloy but without any harmful effect.

It is advised to vary the composition of the subject wear-resistant alloy with the type of working process conforming to an intended application. When applied, for example, by casting or welding, then the alloy is preferred to be essentially composed of 15 to 45% by weight of chromium; 4 to 6% by weight of at least one metal component selected from the group consisting of aluminium and titanium; and nickel as the remainder. Or the alloy preferably has a composition in which part of the nickel component is replaced by 10 to 20% by weight of molybdenum. When applied, for example, by forging, then the alloy is preferred to be essentially formed of 10 to 40% by weight of chromium; 1.5 to 4% by weight of at least one metal component selected from the group consisting of aluminium and titanium; 0 to 10% by weight of molybdenum; and nickel as the remainder.

There will now be described property-evaluation tests made on a wear-resistant alloy embodying this invention.

Various types of wear-resistant alloy were prepared by melting a mixture of metal components in a high frequency vacuum induction furnace and casting a molten mass into shape, followed by heat treatment, for example annealing. Samples were cut of the various types of wear-resistant alloy thus prepared. The wear resistance of the samples was determined by the cavitation erosion test based on ultrasonic vibration, the results being set forth in Table I below together with the compositions of the alloy samples and the conditions of heat treatment to which said samples were subjected. The cavitation erosion index (abbreviated as "C.E.I.") given in Table I denotes a value arrived at by dividing a weight loss (mg) of each sample after 3 hours of ultrasonic vibration by a product of a test time (minutes) and alloy density (g/cm$^3$) and later multiplying the resultant quotient by $1\times10^6$, namely, a loss of volume due to wear per unit length of time.

TABLE I

| Sample | Composition (% by weight) Cr | Al | Ti | Mo | Mn | Si | Fe | Nb | Ni | Conditions of heat treatment | C.E.I. |
|---|---|---|---|---|---|---|---|---|---|---|---|
| Example A | 18.3 | 5.2 | — | — | 0.4 | 0.3 | — | — | remainder | a | 0.9 |
| B | 40.6 | 5.3 | — | — | 0.5 | 0.2 | — | — | remainder | b | 0.8 |
| C | 40.4 | 1.9 | — | — | 0.4 | 0.2 | — | — | remainder | c | 1.4 |
| D | 35.1 | — | 4.2 | — | 0.4 | 0.2 | — | — | remainder | d | 1.1 |
| E | 35.8 | 3.7 | 1.5 | — | 0.3 | 0.3 | — | — | remainder | a | 0.8 |
| F | 14.8 | — | 3.1 | 10.7 | 0.4 | 0.2 | — | — | remainder | d | 1.4 |
| G | 30.2 | 1.6 | 1.4 | 4.8 | 0.5 | 0.3 | — | — | remainder | e | 1.7 |
| H | 36.0 | 1.8 | — | 15.2 | 0.4 | 0.2 | — | — | remainder | f | 1.6 |
| I | 38.1 | 4.4 | — | — | 0.5 | 0.3 | — | 1.1 | remainder | a | 1.0 |
| J | 20.2 | 3.9 | — | 9.7 | 0.4 | 0.3 | 15.7 | — | remainder | a | 1.2 |

Notes:
(1) Conditions under which the cavitation erosion test was carried out:
Vibrator: vibrated by magnetic strain
Frequency: 6,500 Hz
Amplitude of sample: 100 μ
Test liquid: demineralized water at 20° C.
(2) Conditions of heat treatment (the same applies throughout the following tests):
a = 1,200° C. × 2 hours, followed by water cooling, 700° C. × one hour
b = no heat treatment (just as cast)
c = 1,200° C. × 2 hours, followed by water cooling, 700° C. × 50 hours
d = 1,200° C. × 2 hours, followed by water cooling, 800° C. × 20 hours
e = 1,200° C. × 2 hours, followed by water cooling, 700° C. × 30 hours
f = 1,200° C. × 2 hours, followed by water cooling, 800° C. × 30 hours
g = 1,200° C. × 2 hours, followed by water cooling, 800° C. × 50 hours
h = 1,050° C. × 2 hours, followed by oil cooling, 650° C. × 5 hours
i = 1,100° C. × 2 hours, followed by water cooling
j = 1,100° C. × 2 hours, followed by oil cooling, 650° C. × 5 hours.

By way of comparison, the same cavitation erosion test was made on three alloys (controls 1 to 3) falling outside of the specified range of the composition of a wear-resistant alloy embodying this invention; steel containing 1% by weight of chromium, 1% by weight of molybdenum and 0.25% by weight of vanadium (control 4); steel containing 18% by weight of chromium and 8% by weight of nickel (control 5); steel containing 12% by weight of chromium, 1% by weight of molybdenum and 0.2% by weight of vanadium (control 6); and a cobalt-chromium-tungsten alloy sold under the trademark Stellite containing 29.8% by weight of chromium, 4.5% by weight of tungsten, 1.4% by weight of carbon and 1.8% by weight of iron (control 7), the results being presented in Table II below.

TABLE II

| Sample | Composition (% by weight) Cr | Al | Ti | Mo | Mn | Si | Fe | Nb | Ni | Conditions of heat treatment | C.E.I. |
|---|---|---|---|---|---|---|---|---|---|---|---|
| Control 1 | 10.6 | — | — | 5.3 | 0.5 | 0.3 | — | — | remainder | d | 5.6 |

TABLE II-continued

| Sample | Composition (% by weight) Cr | Al | Ti | Mo | Mn | Si | Fe | Nb | Ni | Conditions of heat treatment | C.E.I. |
|---|---|---|---|---|---|---|---|---|---|---|---|
| 2 | 39.8 | 0.9 | — | — | 0.4 | 0.3 | — | — | remainder | g | 3.4 |
| 3 | 30.4 | — | 0.6 | 10.2 | 0.5 | 0.2 | — | — | remainder | g | 3.8 |
| 4 | 1% Cr - 1% Mo - 0.25% V steel | | | | | | | | | h | 5.8 |
| 5 | 18% Cr - 8% Ni stainless steel | | | | | | | | | i | 5.4 |
| 6 | 12% Cr - 1% Mo - 0.2% V steel | | | | | | | | | j | 6.6 |
| 7 | Stellite | | | | | | | | | None | 1.1 |

The same erosion test was made on samples cut out of various types of the wear-resistant alloy embodying this invention which were formed by forging, the results being given in Table III below.

TABLE III

| Sample | Composition (% by weight) Cr | Al | Ti | Mo | Mn | Si | Ni | Conditions of heat treatment | C.E.I. |
|---|---|---|---|---|---|---|---|---|---|
| Example K | 35.3 | 3.6 | — | — | 0.3 | 0.3 | remainder | a | 0.8 |
| L | 30.1 | 2.9 | 0.8 | 5.1 | 0.3 | 0.2 | remainder | a | 1.0 |

An alloy having a composition shown in Table IV below was welded in the raised form onto a piece of stainless steel containing 18% by weight of chromium and 8% by weight of nickel. A sample was cut out of the raised welded section. The same cavitation erosion test was made on the sample, the result being indicated in Table IV below.

TABLE IV

| Sample | Composition (% by weight) Cr | Al | Ti | Mo | Mn | Si | Ni | Conditions of heat treatment | C.E.I. |
|---|---|---|---|---|---|---|---|---|---|
| Example M | 34.7 | 4.1 | 0.9 | 10.4 | 0.4 | 0.3 | remainder | None | 1.4 |

Measurement was made of weight loss resulting from slide wear with respect to examples I and J and Controls 4, 5, 6, the results being set forth in Table V below.

TABLE V

| Sample | Weight loss by slide wears |
|---|---|
| Example I | 2 mg |
| Example J | 3 mg |
| Control 4 | 1,980 mg |
| Control 5 | 165 mg |
| Control 6 | 75 mg |
| Stellite | 4 mg |

Note:
The slide wear test was carried out under the following conditions:
Testing machine used: Amsler-type slide wear testing machine
Rotor: made of 18% Cr-8% Ni stainless steel
Number of revolution: 210 r.p.m.
Load: 30 kg
Slide distance: 1,000 m
Lubricant and cooling agent: water (200 cc/hr)

The above-mentioned results of the tests of evaluating the property of wear-resistant alloys clearly show that those of this invention have a prominent resistance to cavitation erosion and slide wear. Moreover, the wear-resistant alloys of the invention indicate a resistance to corrosion and erosion equal to, or higher than, that of a cobalt-chromium-tungsten alloy sold under the trademark Stellite hitherto used as wear-resistant material for an atomic power plant, and, what is better, are free from cobalt which has been found to be an undesirable component of a wear-resistant alloy used with such power plant. Accordingly, the wear-resistant alloys of the invention prove to be very effective wear-resistant materials for an atomic power plant. Atomic power plant parts, such as an erosion shield provided for the terminal blade of the low pressure section of a turbine, the face section of valves, the chamber of a jet pump and the slide section of control rods, prepared from any of the wear-resistant alloys of the invention, are subject to little wear during the operation of an atomic power plant. Should a fine particulate refuse resulting from the wear of these atomic power plant parts be rendered radioactive by bombardment of neutrons in the reactor, said radioactivity would have a very short half life.

What we claim is:

1. Forged atomic power plant parts, subjected to severe wear and cavitation erosion which give rise to wear and cavitation erosion products rendered radioactive by neutron bombardment but having a very short radioactive half life, which are prepared from an alloy consisting essentially of 30 to 40% by weight of chromium; 1.5 to 4% by weight of at least one metal component selected from the group consisting of aluminium and titanium; 0 to 10% by weight of molybdenum; and nickel.

2. The atomic power plant parts according to claim 1, one of which is an erosion shield provided for the terminal blade of the low pressure section of a turbine.

3. The atomic power plant parts according to claim 1, one of which is the face section of valve.

4. The atomic power plant parts according to claim 1, one of which is the chamber of a jet pump.

5. The atomic power plant parts according to claim 1, including the sliding sections of control rods.

6. Forged atomic power plant parts, subjected to cavitation erosion which gives rise to cavitation erosion products rendered radioactive by neutron bombardment but having a very short radioactive half life, which are prepared from an alloy consisting essentially of 30 to 40% by weight of chromium; 1.5 to 4% by weight of at least one metal component selected from the group consisting of aluminium and titanium; 0 to 10% by weight of molybdenum; and nickel.

* * * * *